US008272312B2

(12) United States Patent
Kneppler et al.

(10) Patent No.: US 8,272,312 B2
(45) Date of Patent: Sep. 25, 2012

(54) BREECH FOR A REPEATING RIFLE AND BARREL FOR SUCH A BREECH

(75) Inventors: Mathias Kneppler, Burgberg (DE); Meinrad Zeh, Weitnau-Seltmans (DE); Hans-Peter Schwärzler, Weiler (DE); Jürgen Rothärmel, Altusried (DE); Christian Scherpf, Obersfeld (DE)

(73) Assignee: Blaser Finanzholding GmbH, Isny (DE)

( * ) Notice: Subject to any disclaimer, the term of this patent is extended or adjusted under 35 U.S.C. 154(b) by 337 days.

(21) Appl. No.: 12/480,072

(22) Filed: Jun. 8, 2009

(65) Prior Publication Data

US 2009/0308240 A1 Dec. 17, 2009

(30) Foreign Application Priority Data

Jun. 11, 2008 (DE) ..... 20 2008 007 768 U

(51) Int. Cl.
*F41A 3/16* (2006.01)

(52) U.S. Cl. ..... 89/180

(58) Field of Classification Search ..... 89/180, 89/190, 164, 169, 175, 176, 189; 42/16
See application file for complete search history.

(56) References Cited

U.S. PATENT DOCUMENTS

| | | | | | |
|---|---|---|---|---|---|
| 1,095,738 | A * | 5/1914 | Carl | 89/144 |
| 2,370,189 | A * | 2/1945 | Penney | 89/152 |
| 2,775,166 | A * | 12/1956 | Janson | 89/190 |
| 2,861,374 | A * | 11/1958 | Hampton | 42/16 |
| 3,613,282 | A * | 10/1971 | Ramsay | 42/17 |
| 4,815,356 | A * | 3/1989 | Hupp et al. | 89/190 |
| 5,259,137 | A * | 11/1993 | Blenk et al. | 42/16 |
| 5,458,046 | A * | 10/1995 | Blenk et al. | 89/190 |
| 5,682,007 | A * | 10/1997 | Dobbins | 89/187.02 |
| 6,622,609 | B1 * | 9/2003 | Barkan | 89/180 |
| 6,820,533 | B2 * | 11/2004 | Schuerman | 89/190 |
| 7,478,494 | B2 * | 1/2009 | Zeh | 42/25 |
| 8,091,466 | B2 * | 1/2012 | Kneppler et al. | 89/190 |
| 2007/0012170 | A1 * | 1/2007 | Spielberger | 89/196 |

FOREIGN PATENT DOCUMENTS

DE 4305700 C1 10/1994

* cited by examiner

*Primary Examiner* — Michael Carone
*Assistant Examiner* — Reginald Tillman, Jr.
(74) *Attorney, Agent, or Firm* — Martin Fleit; Paul D. Bianco; Fleit Gibbons Gutman Bongini & Bianco PL

(57) ABSTRACT

The invention relates to a breech for a repeating rifle with a breech guide, a locking chamber arranged in the breech guide, and a locking sleeve that is arranged concentrically about a rear part of the locking chamber and that has several locking elements that can be moved by an expansion device between an inner unlocked position and an outer locked position for engaging in a locking groove of a barrel. The expansion device has, according to the invention, a support sleeve that can move in the axial direction between the rear of the locking chamber and the locking sleeve.

20 Claims, 10 Drawing Sheets

BREECH FOR A REPEATING RIFLE AND BARREL FOR SUCH A BREECH

CROSS REFERENCE TO RELATED APPLICATION

This application claims priority under 35 U.S.C. §119 to German Patent Application No. 20 2008 007 768.0 filed Jun. 11, 2008, the entire contents of which are incorporated herein by reference.

FIELD OF THE INVENTION

The present invention relates to a breech for a repeating rifle. The invention also relates to a barrel for such a breech.

BACKGROUND OF THE INVENTION

From DE 43 05 700 C1, a breech of a repeating rifle according to the class is known. In that document, a locking chamber and a locking sleeve arranged concentric about this locking chamber are arranged within a locking guide that is displaceable on a system casing. The locking sleeve constructed as an expansion sleeve is divided on its front end by longitudinal slots into several flexible spring tongues. The spring tongues have, on their front ends, locking elements for engaging in an annular groove on the inside of the barrel. By means of an expansion cone provided on the locking chamber, the locking elements constructed integrally with the spring tongues of the locking sleeve can move between a radially inner unlocked position and a radially outer locked position. For this known breech, the expansion of the locking sleeve constructed as an expansion sleeve is achieved by its axial displacement against the expansion cone formed on the locking chamber.

SUMMARY OF THE INVENTION

The task of the invention is to create an alternative breech for a repeating rifle and an associated barrel that enable particularly stable and safe locking.

This task is achieved by a breech with the features as set forth in the claims and by an associated barrel as also set forth in the claims. Preferred improvements and advantageous embodiments of the invention are set forth below.

For the breech according to the invention, the expansion device for moving the locking elements between the inner unlocked position and the outer locked position is constructed as a support sleeve that can be displaced in the axial direction between the rear part of the locking chamber and the locking sleeve. By means of this support sleeve, a particularly stable and safe support of the locking sleeve is achieved primarily in the region of the locking elements. The locking elements are supported over a large surface area in their locked position by the support sleeve, by means of which a high degree of safety against undesired opening of the breech is achieved even for impermissibly elevated gas pressures. By means of the support sleeve, the locking elements on the locking sleeve can moreover be safely moved into the locked position also with relatively steep contact surfaces. By means of the steep contact surfaces, the radial forces acting on the barrel can be reduced and therefore the stability can be improved.

In a preferred construction, the locking sleeve is constructed as an expansion sleeve with several spring tongues that have, on the front end, the locking elements and, on their inside, run-on beveling for engaging with a front end of the support sleeve. Through the axial movement of the support sleeve relative to the locking sleeve, the locking elements provided on the spring tongues can be moved in a relatively easy and safe way between the radially inner unlocked position and the radially outer locked position.

In a construction that is particularly advantageous for the expansion of the locking sleeve and the force transmission, the locking chamber has, at the transition between the narrower, rear part and an enlarged breech head, a rear abutment surface inclined at an angle β of 80° to 85°, advantageously 83°, to the center axis of the locking chamber for correspondingly inclined front contact surfaces on the locking elements. The locking elements further contain relatively steep rear contact surfaces that are inclined in the locking position at an angle of 70° to 80°, advantageously 75°, to the center axis of the locking chamber and are led, in the locking position, into contact on a correspondingly steep, rear locking surface in a locking groove of the barrel. Through the steep construction of the contact surfaces, the spring tongues of the locking sleeve are loaded by the forces acting during the discharge of a shot due to the gas pressure less in the radial direction, but instead mainly in the axial direction, by means of which an optimized force transmission between the locking elements and the barrel is achieved.

The barrel belonging to the breech described above has, according to the invention, a relatively steep, rear locking surface for contact with the rear contact surfaces of several locking elements arranged on a locking sleeve. The rear locking surface is inclined at an angle α of 70° to 80°, advantageously 75°, relative to a center axis of the barrel. The pressure forces F acting on the barrel during the discharge of a shot through the locking elements thus have a relative large component $F_x$ in the axial direction and only a relatively small component $F_y$ in the radial direction, so that expansion of the barrel end caused, e.g., by increased gas pressure is prevented and thus the stability and safety of the locking can be improved.

BRIEF DESCRIPTION OF THE FIGURES

Other special features and advantages of the invention emerge from the following description of a preferred embodiment with reference to the drawing. Shown are.

DETAILED DESCRIPTION OF THE INVENTION

Figure 1:
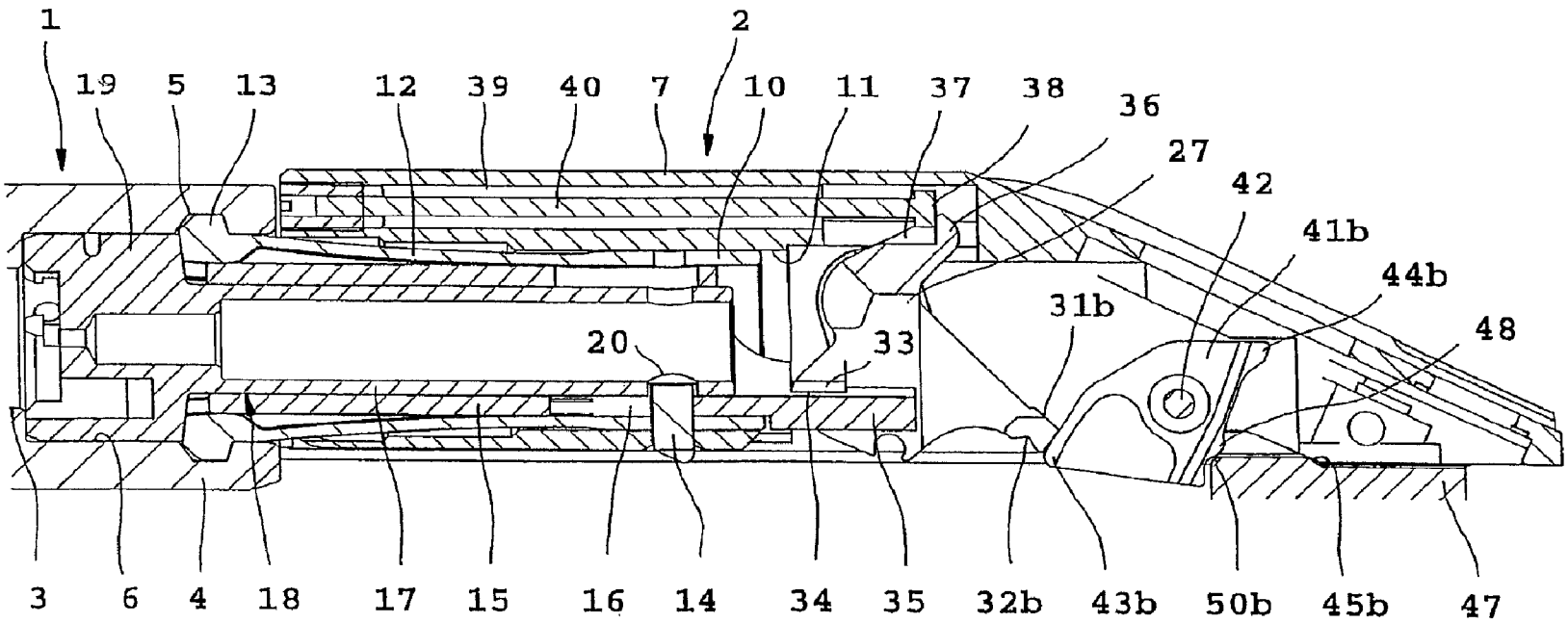
FIG. 1: the rear part of a barrel and a locked breech of a repeating rifle in a longitudinal section.

In FIG. 1, the rear part of a barrel 1 and a breech 2 of a repeating rifle in a locked position are shown. On its rear end, the barrel 1 has a cartridge holder 3 and a locking head 4 with a locking groove 5 on the inner wall of a receptacle borehole 6.

Figure 2:
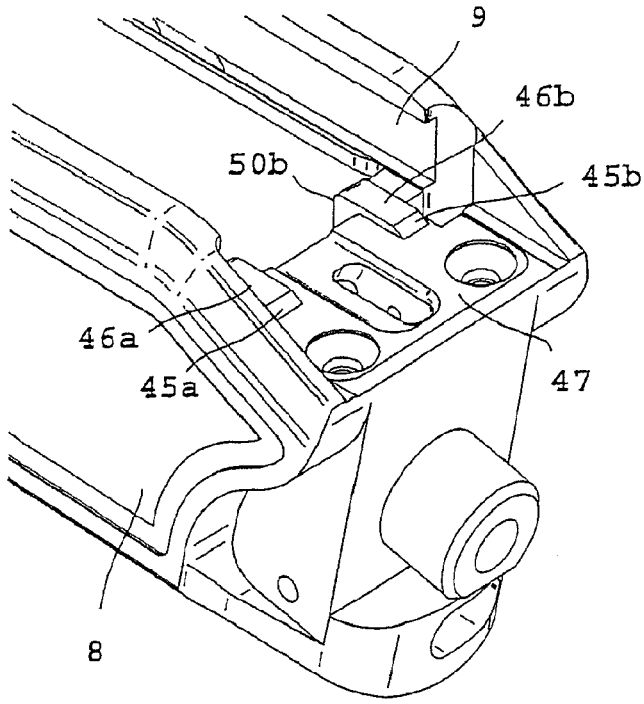
FIG. 2: a part of a system casing of a repeating rifle in a perspective view from the rear.
Figure 3:
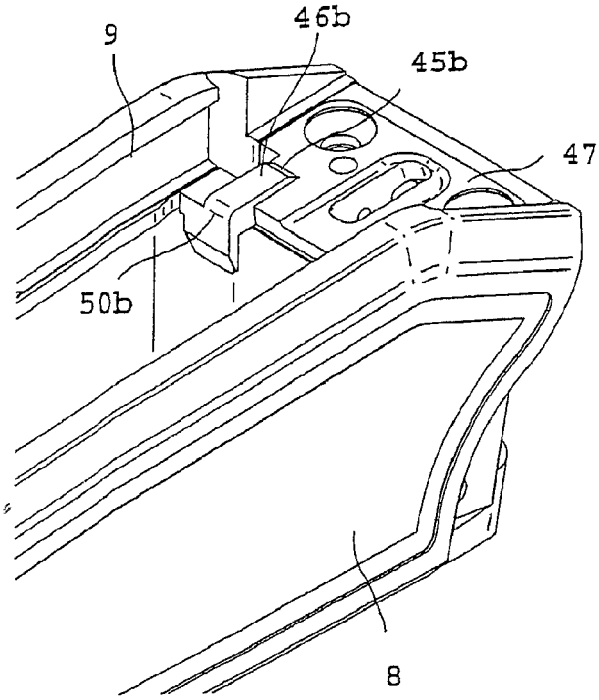
FIG. 3: a part of the system casing of FIG. 2 in a perspective view from the front.

The breech 2 contains a breech guide 7 that is constructed as a slide and that is guided so that it can move on a system casing 8 shown partially in FIGS. 2 and 3 by means of side longitudinal guides 9. The breech 2 further contains a locking sleeve 10 that is constructed here as an expansion sleeve and that is arranged in a borehole 11 expanded frontwards with a step shape in the breech guide 7 and that contains, at its front part, several spring tongues 12 divided by longitudinal slots. On their front end, the spring tongues 12 have locking elements 13 in the form of thicker sections for engaging in the locking groove 5 of the barrel 1.

The locking sleeve 10 is fixed in the axial direction by a safety piece constructed as a chamber holder 14 within the breech guide 7. Within the locking sleeve 10, a support sleeve 15 that is coaxial to this locking sleeve is guided so that it can move in the axial direction by a predetermined amount. For this purpose, the support sleeve 15 has, in the region of the chamber holder 14, a recess 16. Through the dimensions of the recess 16, the displacement of the locking sleeve 10 is limited. Within the support sleeve 15, the rear, narrower part 17 of an essentially cylindrical locking chamber 18 is arranged coaxial to the support sleeve 15. The rear part 17 of the locking chamber 18 is thus surrounded coaxially by the locking sleeve 10, wherein, between the rear part 17 of the locking chamber 18 and the locking sleeve 10, the axial displaceable support sleeve 15 is arranged.

The locking chamber 18 further has, in addition to the narrower rear part 17, a breech head 19 that is enlarged and projects frontwards relative to the locking sleeve 10 and the breech guide 7 for engaging in the receptacle borehole 6 of the locking head 4 at the end of the barrel 1. In the narrower, rear part 17 of the locking chamber 18, there is a side opening 20 for engaging the chamber holder 14. The side opening 20 in the locking chamber 18 is somewhat larger than the chamber holder 14, so that the locking chamber 18 can move in the axial direction by a small amount relative to the breech guide 7. In a known way, in the locking chamber 18, the firing pin and an associated firing-pin spring are housed. The firing pin and the firing-pin spring are not shown, because their arrangement within the locking chamber 18 is known.

Figure 4:
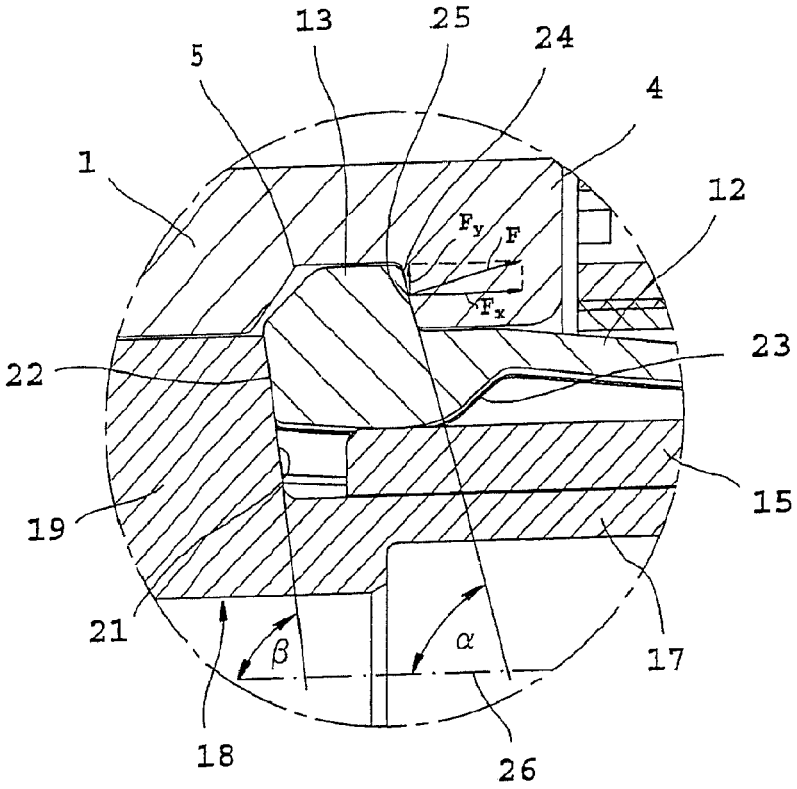
FIG. 4: the front region of a locking chamber of the breech shown in FIG. 1 in an enlarged partial view.

From the enlarged partial view of the front region of the locking chamber 18 according to FIG. 4 it emerges that the locking chamber 18 has, on the rear side of the breech head 19 enlarged in diameter, in the transition region to the narrower rear part 17, a conical, rear abutment surface 21 for front, cone segment-shaped contact surfaces 22 on the locking elements 13 at the end of the spring tongues 12 of the locking sleeve 10. The spring tongues 12 contain, on the inside in the region of the transition to the locking elements 13, inner run-on beveling 23 for spreading apart the spring tongues 12 by the support sleeve 15. Through a frontwards movement of the support sleeve 15, the spring tongues 12 can thus be spread apart and the locking elements can be moved from an unlocked position shown in FIG. 6 into a locked position shown in FIG. 1. The locking elements 13 contain backwards-directed, rear cone segment-shaped contact surfaces 24 that interact in the locked position shown in FIG. 4 with a rear locking surface 25 on the rear side of the locking groove 5 in the locking head 4 of the barrel 1. The rear locking surface 25 of the barrel 1 has, relative to the center axis 26 of the barrel 1 and the locking chamber 18, a relatively steep angle $\alpha$ of 70° to 80°, advantageously 75°. The rear contact surfaces 24 are constructed so that, in the locked position, these also assume the angle $\alpha$ and thus form a planar contact on the locking surface 25 of the barrel 1. The conical abutment surface 21 of the locking chamber 18 is inclined, relative to the center axis 26 of the barrel 1 and the locking chamber 18, by an angle $\beta$ between 80° and 85°, advantageously 83°. The cone segment-shaped, front contact surfaces of the locking elements 13 on the end of the spring tongues 12 are also inclined at the angle $\beta$ to the center axis 26. Through the steep construction of the locking surface 25 in the locking groove 5 of the barrel 1, pressure forces F acting on the barrel 1 during the discharge of a shot by the locking elements 13 have a relatively large component $F_x$ in the axial direction and only a relatively small component $F_y$ in the radial direction, as shown by the arrows in FIG. 4. In this way, a load-generated expansion of the barrel end can be prevented and thus the stability of the locking can be improved.

Figure 5:
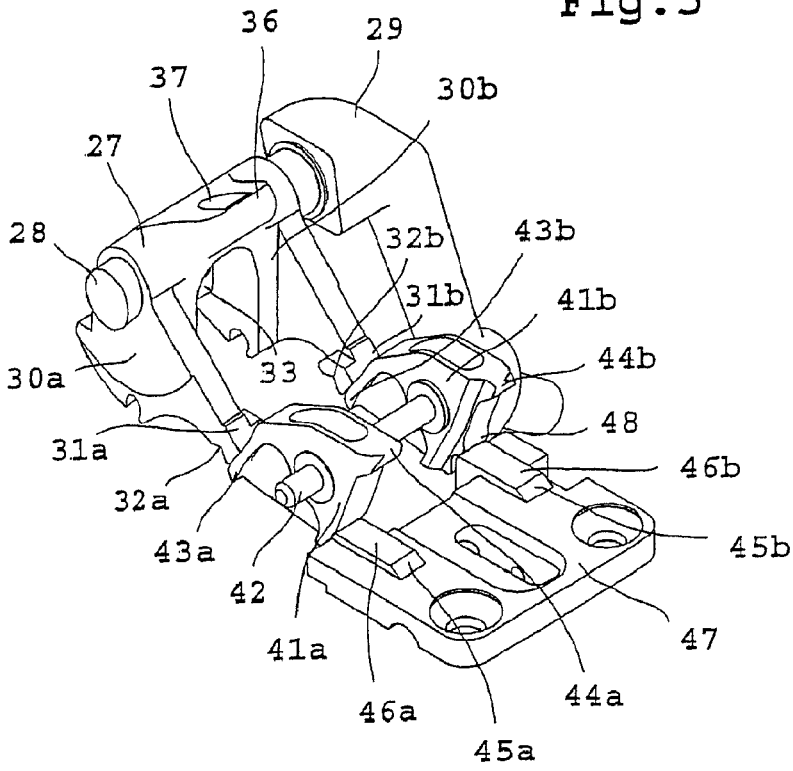
FIG. 5: a breech lever with cam elements of the breech shown in FIG. 1 in a perspective view.

In the breech guide 7, a breech lever 27 shown in perspective in FIG. 5 is mounted so that it can rotate about an axis 28 running perpendicular to the breech guide 7. The breech lever 27 can be activated by a chamber stem 29 and contains, on the bottom side, two parallel legs 30*a* and 30*b*, each having a backwards projecting locking shoulder 31*a* or 31*b* with a recess 32*a* or 32*b* on the bottom side. On the inside of the right leg 30*b*, there is an inwards projecting shoulder 33 for the positive-fit engagement in a recess 34 that can be seen in FIG. 1 on a rear projection 35 of the support sleeve 15. On the top side, the breech lever 27 contains a tab 36 with a recess 37 in which engages a head 38 shown in FIG. 1 of an unlocking pin 40 guided so that it can move in the longitudinal direction in a longitudinal borehole 39 of the breech guide 7. By means of the rear locking shoulders 31*a* and 31*b*, the breech lever 27 is engaged with two cam elements 41*a* and 41*b* that are arranged on a common cross axis 42 so that they can rotate in the breech guide 7 and receive a force in the clockwise direction from not-shown springs. The cam elements 41*a* and 41*b* constructed as cam discs respectively contain a front catch tab 43*a* and 43*b* for engaging the recess 32*a* or 32*b* of the breech lever 27 and a rear control shoulder 44*a* or 44*b* for engaging with control surfaces 45*a* and 45*b* on the system casing 8. In the shown embodiment, the control surfaces 45*a* and 45*b* are formed on raised sections 46*a* and 46*b* of a control plate 47 mounted on the system casing 8. On the cam element 41*b* on the right in FIG. 5, another control cam 48 is provided.

Below, the function of the breech will be explained with reference to FIGS. 6-12, wherein, in each of FIGS. 6*a*-12*a*, the left cam element 41*a* is shown and, in each of FIGS. 6*b*-12*b*, the right cam element 41*b* is shown.

Figure 6B:
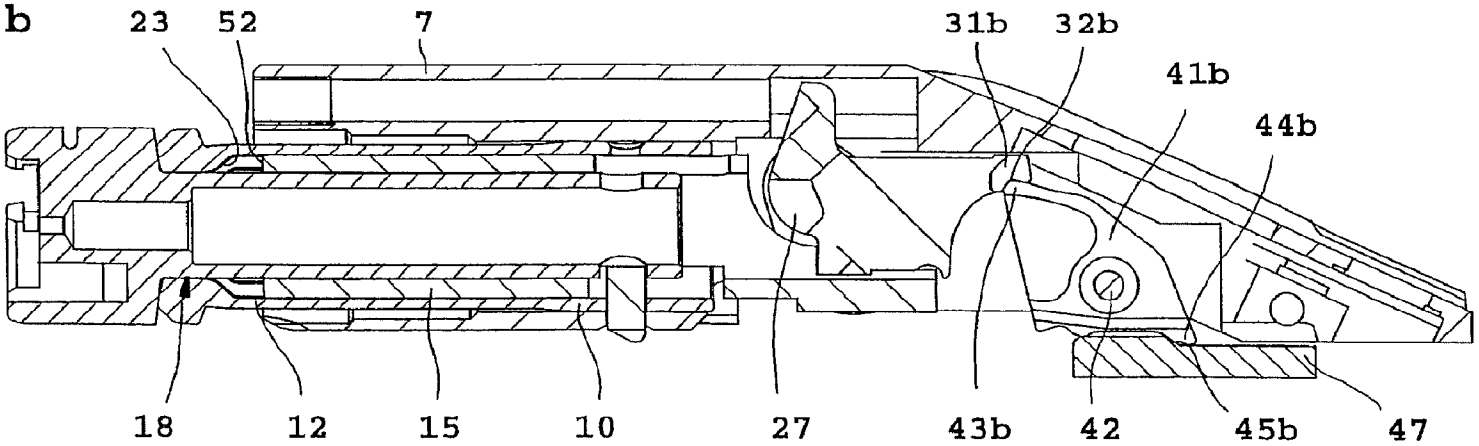
FIGS. 6*a*, 6*b*: the breech of FIG. 1 shortly before the unlatching of the cam elements on the breech lever.
Figure 6A:
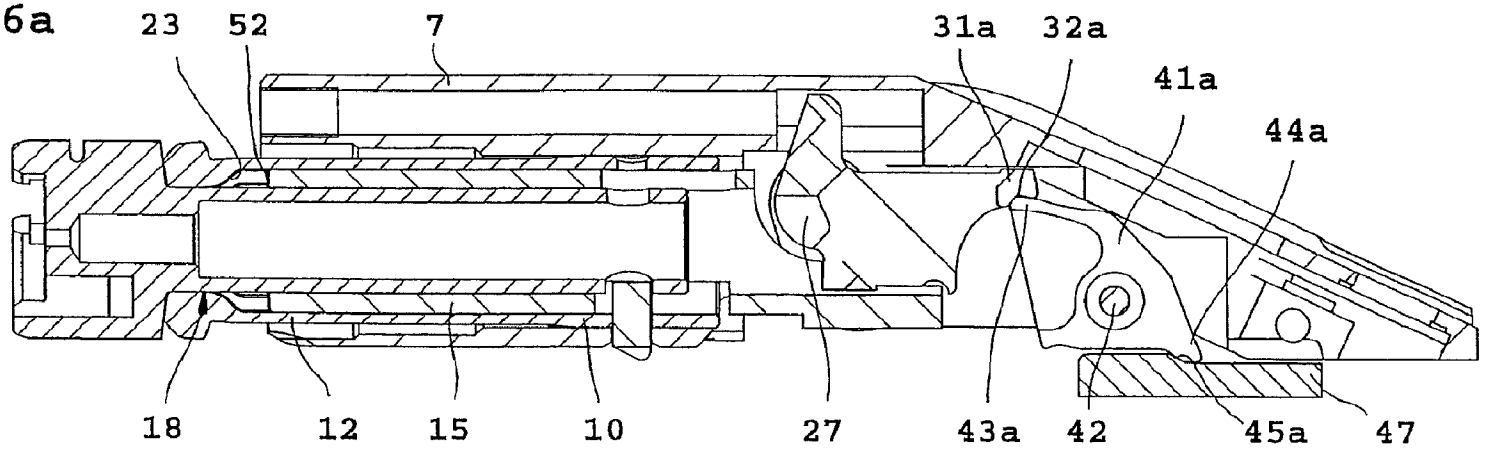

In the open position of the breech 2 shown in FIGS. 6*a* and 6*b*, the chamber stem 29 is pivoted backward, by means of which the rear locking shoulders 31*a* and 31*b* of the breech lever 27 are rotated upward and the front catch tabs 43*a* and 43*b* of the respective cam elements 41*a* and 41*b* biased in the clockwise direction by springs respectively engage in the recesses 32*a* and 32*b* on the locking shoulders 31*a* and 31*b* of the breech lever 27. However, also on only one of the locking shoulders 31*a* or 31*b*, a recess 32*a* or 32*b* can be provided in which an associated catch tab 43*a* or 43*b* of the cam element 41*a* or 41*b* can engage in a locking way. Through this locking, the chamber stem 29 is blocked against rotation, and the breech guide 7 can be pushed backward and frontward within the guide 9 of the system casing 8 shown in FIG. 2 with the help of the chamber stem 29. In the open position of the breech 2, the support sleeve 15 is located in a retracted position in which a front end 52 of the support sleeve 15 is spaced apart from the inner run-on beveling 23 on the spring tongues 12 of the locking sleeve 10. Therefore, the spring tongues 12 of the locking sleeve 10 are located in an unlocked position pivoted inward.

Figure 7B:
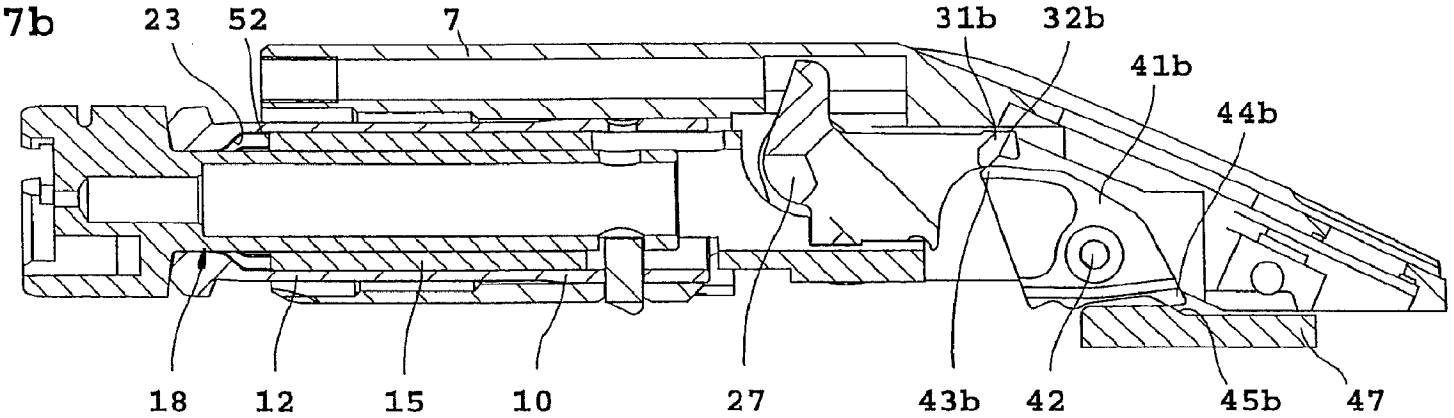
FIGS. 7*a*, 7*b*: the breech of FIG. 1 during the advancement by the cam elements.
Figure 7A:
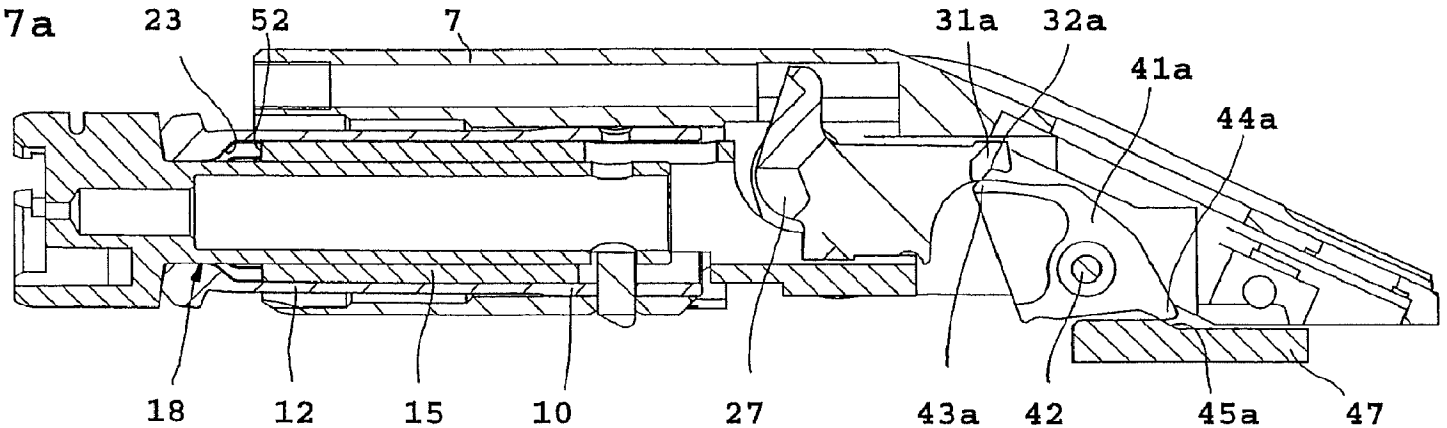

When the breech guide 7 is pushed farther forward relative to the control plate 47 arranged fixed on the system casing 8 past the position shown in FIGS. 6*a* and 6*b*, the two rear control shoulders 44*a* and 44*b* of the cam elements 41*a* and 41*b* according to FIGS. 7*a* and 7*b* are lifted by the beveled control surfaces 45*a* and 45*b*, by means of which the front catch tabs 43*a* and 43*b* are respectively led out of the recesses 32*a* and 32*b* and the lock between the cam elements 41*a* and 41*b* and the breech lever 27 is released. Thus, the chamber stem 29 can be pivoted frontwards.

Figure 8B:
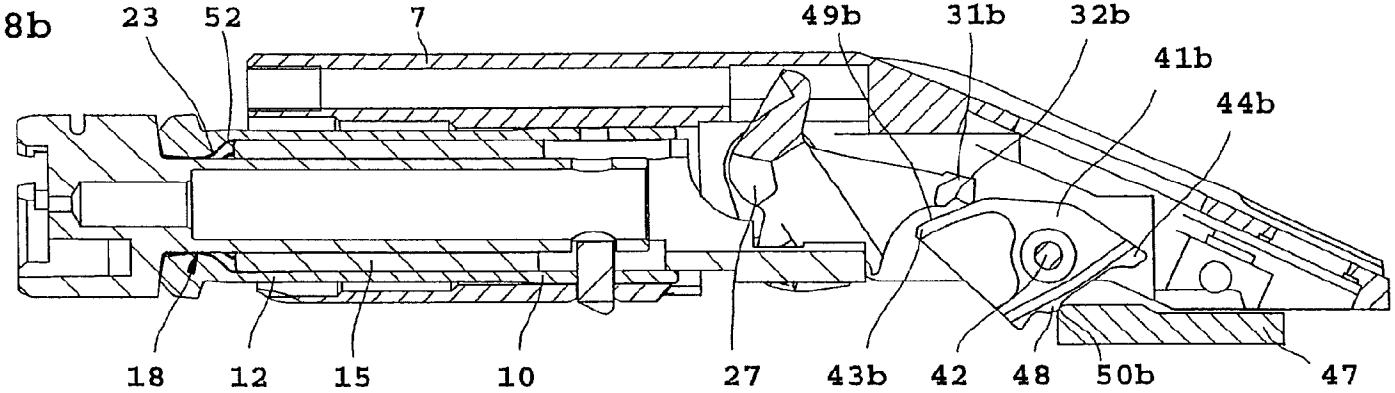
FIGS. 8*a*, 8*b*: the breech of FIG. 1 shortly before the expansion of the locking sleeve by the support sleeve.
Figure 8A:
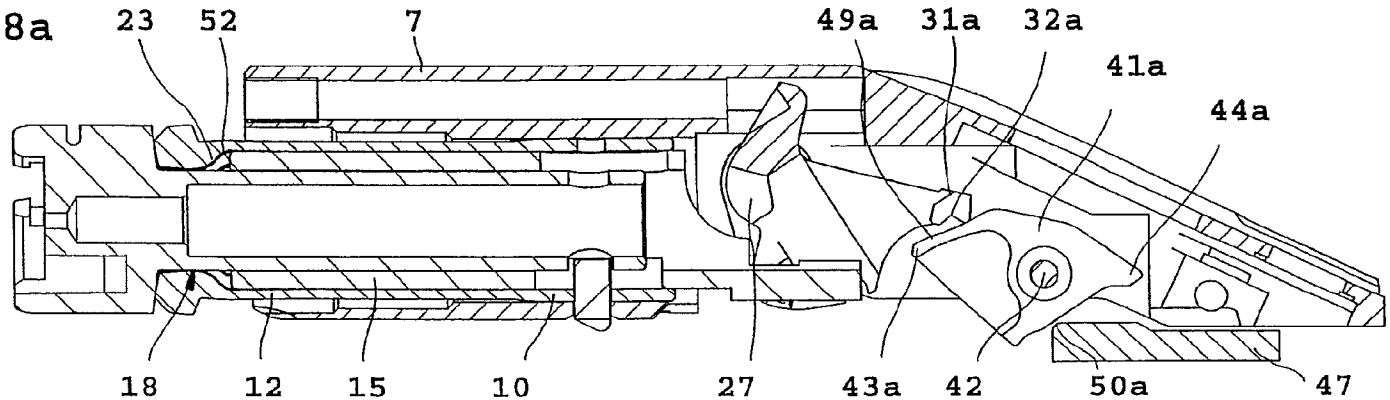

For the forward pivoting of the chamber stem 29 and the resulting rotation of the breech lever 27, the locking shoulders 31*a* and 31*b* press onto a front, beveled surface 49*a* or 49*b* of the cam elements 41*a* and 41*b*, by means of which the front catch tabs 43*a* and 43*b* according to FIGS. 8*a* and 8*b* are pressed downward until the control cam 48 on the right cam element 41*b* according to FIG. 8*b* is led into contact with a front edge 50*b* of the raised section 46*b*. In contrast, in this position the left cam element 41*a* does not yet contact the front edge 50*a* of the raised section 46*a*, as can be seen from FIG. 8*a*.

Figure 9B:
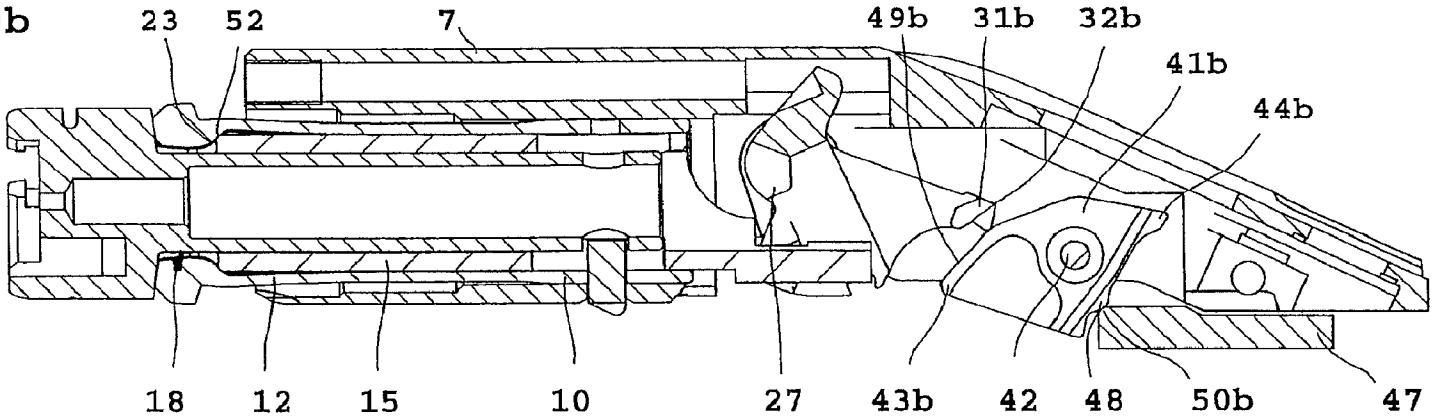
FIGS. 9*a*, 9*b*: the breech of FIG. 1 at the beginning of the expansion of the locking sleeve by the support sleeve.
Figure 9A:
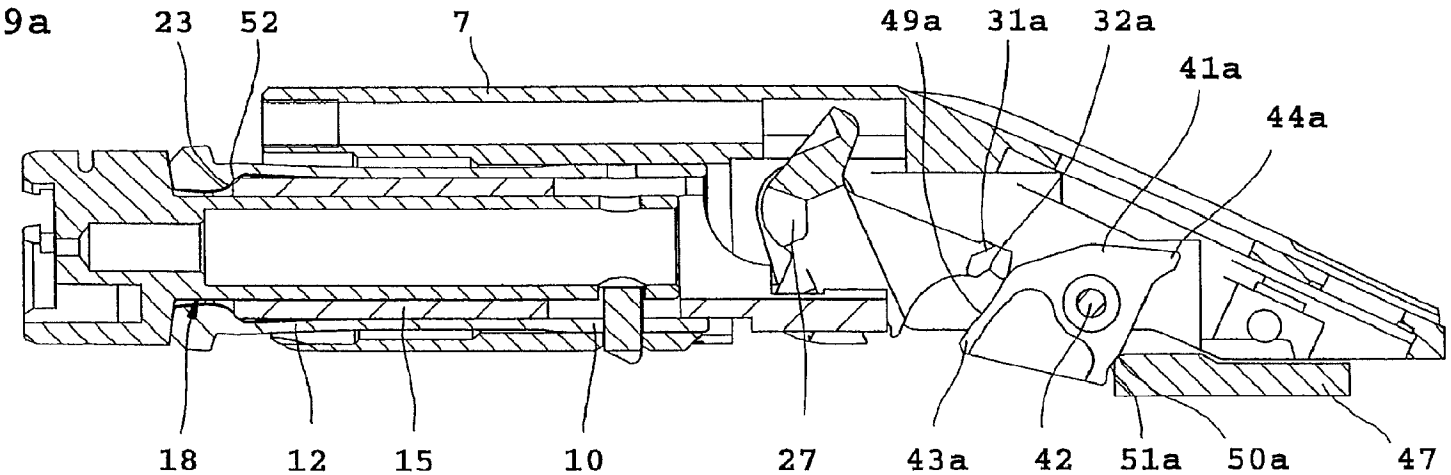

Through the further rotation of the breech lever 27 according to FIGS. 9*a* and 9*b*, the two cam elements 41*a* and 41*b* are further rotated by means of the contact of the locking shoulders 31*a* and 31*b* on the respective front surfaces 49*a* and 49*b* of the cam elements 41*a* and 41*b* until the left cam element 41*a* according to FIG. 9*a* with a rear surface 51*a* is led into contact on the front edge 50*a* of the raised section 46*a*. Simultaneously, the right cam element 41*b* is led out of engagement with the control plate 47, so that the further advance of the breech guide 7 is taken over by the left cam element 41*a*. In this phase, the support sleeve 15 is also pushed forward by means of the breech lever 27 until its front end 52 comes into contact with the run-on beveling 23 on the spring tongues 12 of the locking sleeve 10 constructed as an expansion sleeve 12.

Figure 10B:
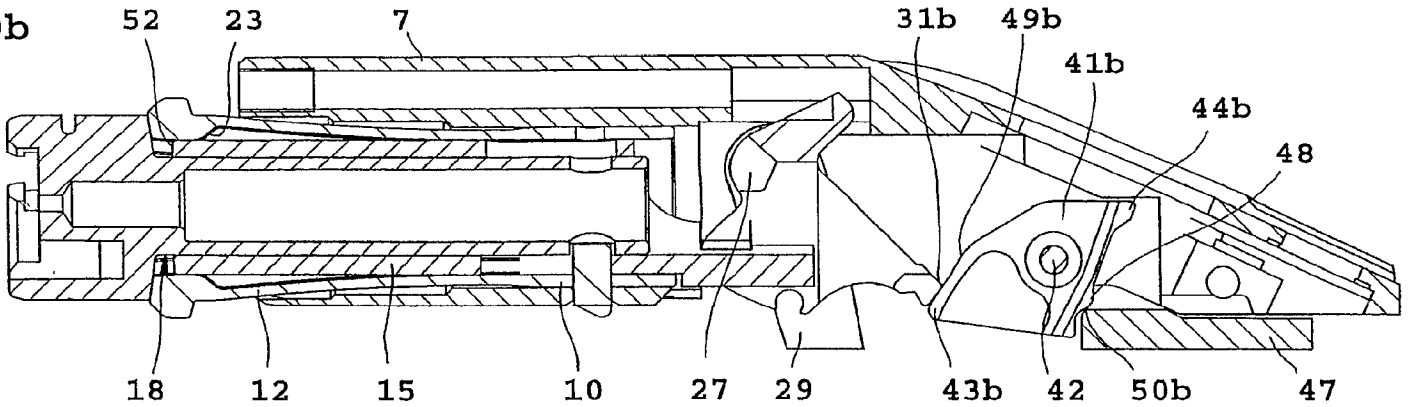
FIGS. 10*a*, 10*b*: the breech of FIG. 1 in the locked position.
Figure 10A:
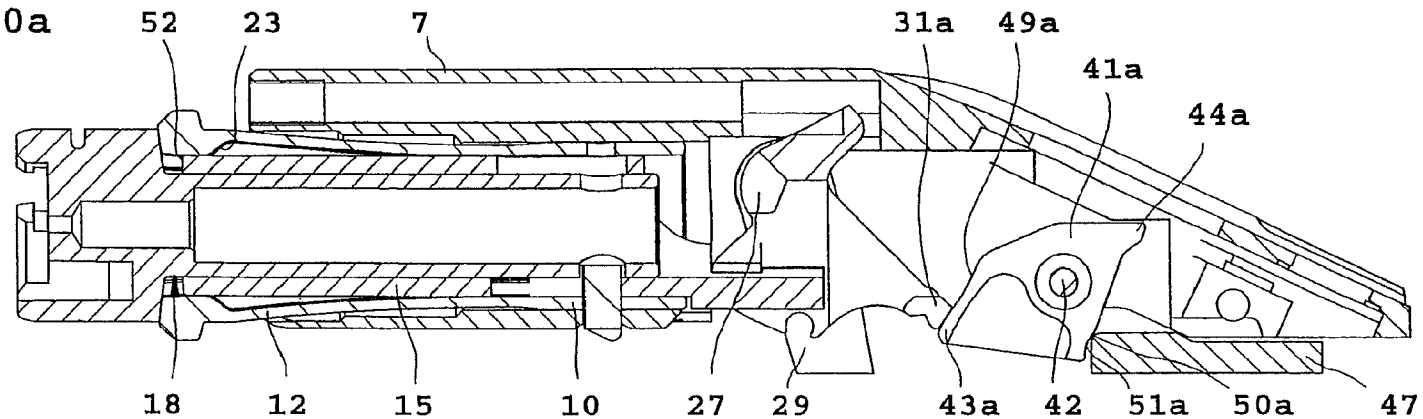
Figure 11B:
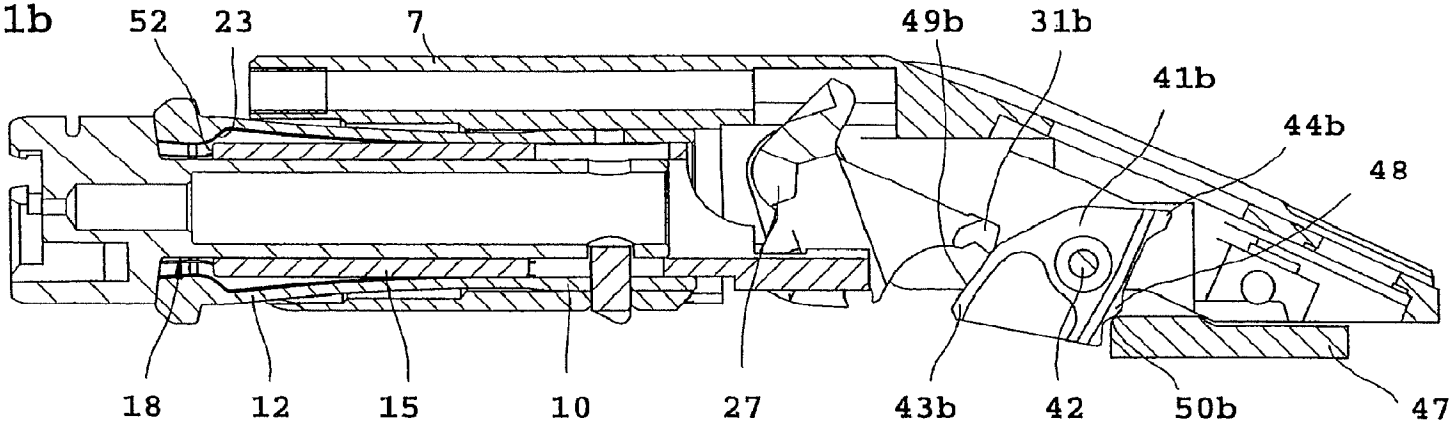
FIGS. 11*a*, 11*b*: the breech of FIG. 1 at the beginning of the opening process.
Figure 11A:
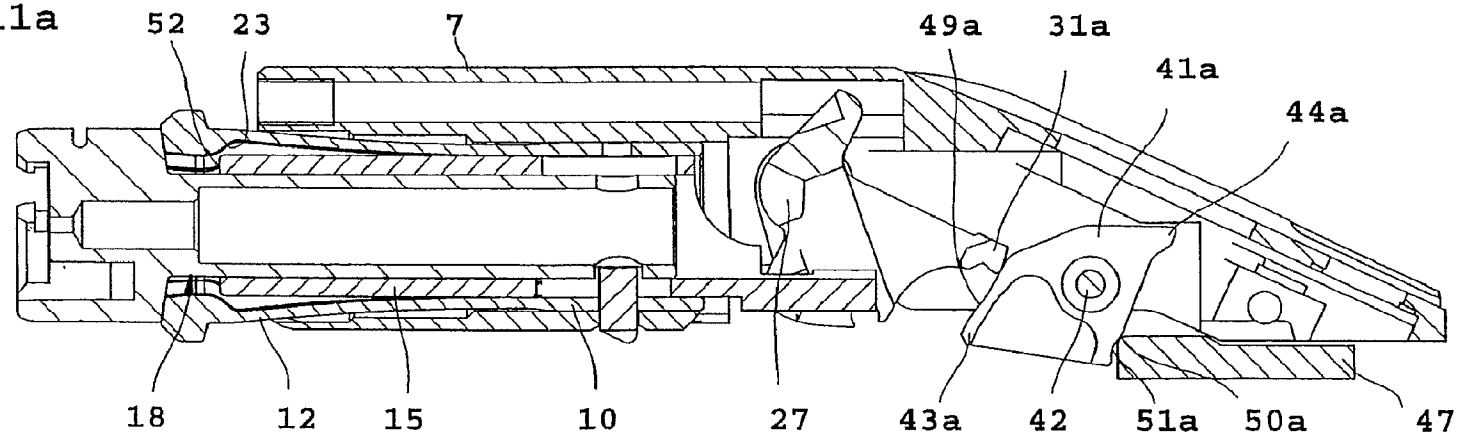

If the breech lever 27 is rotated farther, due to the forward pivoting of the chamber stem 29 into the locking position shown in FIGS. 10*a* and 10*b*, the front catch tabs 43*a* and 43*b* of the cam elements 41*a* and 41*b* are lowered farther due to the contact of the locking shoulders 31*a* and 31*b* of the breech lever 27 on the respective beveled, front surfaces 49*a* and 49*b* of the cam elements 41*a* and 41*b*, wherein the breech guide 7 is shifted somewhat forward by the left cam element 41*a*. Simultaneously, the support sleeve 15 is pushed farther forward by means of the shoulder 33 that can be seen in FIG. 5 under the thicker sections 13, so that the spring tongues 12 of the locking sleeve 10 are expanded outward and the thicker sections 13 are led into the annular groove 5 of the barrel 1, as is shown in FIGS. 1 and 4. In this way, secure locking is achieved.

For opening the breech 2, the chamber stem 29 is retracted and thus the breech lever 27 is rotated for raising the rear locking shoulders 31*a* and 31*b*. As emerges from FIGS. 11*a* and 11*b*, the right cam element 41*b* is first rotated for lowering the control shoulder 44*b*, while the left cam element 41*a* remains in the locked position and the breech guide 7 stops in the front position. Through the rotation of the breech lever 27, the support sleeve 15 is also retracted, so that the spring tongues 12 can again be moved inward due to their elasticity.

Figure 12B:
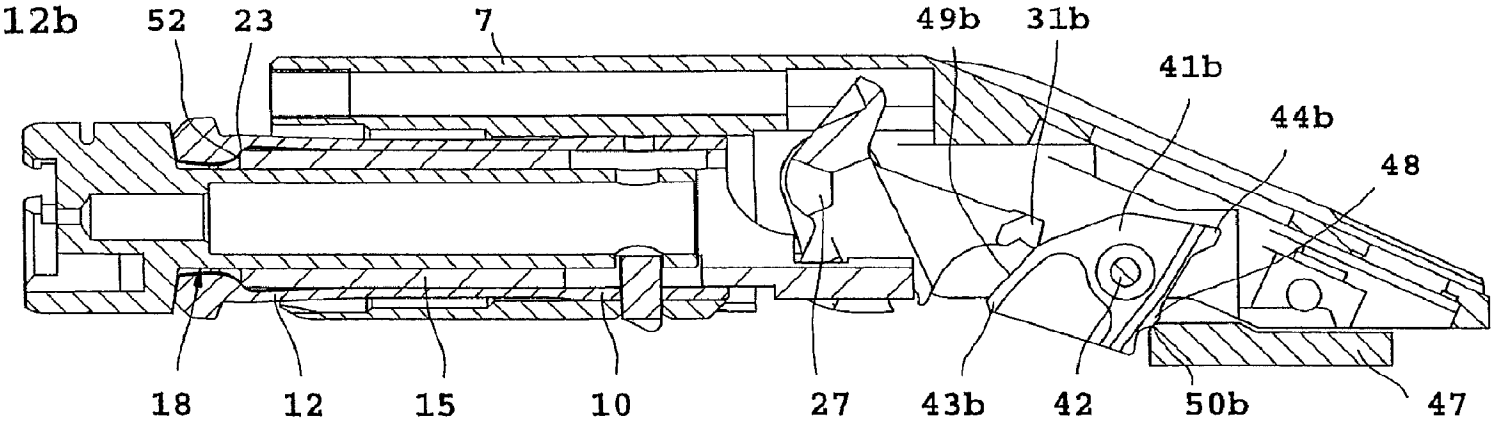
FIGS. 12*a*, 12*b*: the breech during the opening process with a still locked locking sleeve.
Figure 12A:
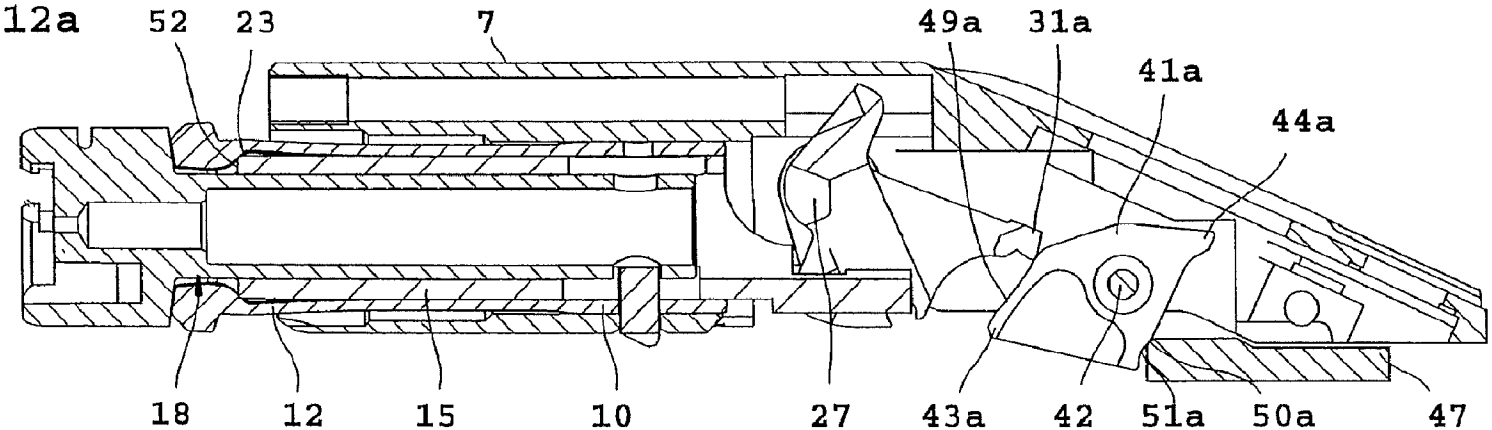

For the further retraction of the chamber stem 29, rear locking shoulders 31*a* and 31*b* of the breech lever 27 according to FIGS. 12*a* and 12*b* are lifted farther, so that the left cam element 41*a* is also rotated. Only when the spring tongues 12 of the locking sleeve 10 are located in the radially inner unlocked position is the breech guide 7 released for displacement toward the rear.

When the chamber stem 29 is retracted, the upward projecting tab 36 of the breech lever is also rotated forward and presses on the head 38 of the releasing pin 40 that is shown in FIG. 1 and that is therefore pushed forward against the barrel 1 and supports the opening of the breech 2 when a cartridge is jammed.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

The invention claimed is:

1. A breech for a repeating rifle and a system casing comprising:

a breech guide;

a locking chamber arranged in the breech guide;

a locking sleeve arranged concentrically about a rear part of the locking chamber, the locking sleeve having a plurality of locking elements;

an expansion device constructed as a support sleeve, the expansion device moving the plurality of locking elements between an inner unlocked position and an outer locked position engaging in a locking groove of a barrel of the rifle and the support sleeve moving in an axial direction between the rear part of the locking chamber and the locking sleeve, wherein the support sleeve is activated by a breech lever pivoted by a chamber stem; and first and second cams separately rotatable with respect to the other, each of the first and second cams having a front cam surface engageable with the breech lever and rear cam surface engageable with the system casing.

2. The breech according to claim 1, wherein the locking sleeve is constructed as an expansion sleeve including a plurality of front spring tongues having run-on beveling, the run-on beveling engaging with a front end of the support sleeve.

3. The breech according to claim 1, wherein, at a transition between a narrower, rear part and an enlarged breech head, the locking chamber comprises a rear abutment surface inclined at an angle $\beta$ of about 80° to about 85° to a center axis of the locking chamber for correspondingly inclined front contact surfaces of the locking elements.

4. The breech according to claim 3, wherein the angle $\beta$ is 83°.

5. The breech according to claim 1, wherein the locking elements comprise, in a locked position, rear contact surfaces inclined at an angle $\alpha$ of about 70° to about 80° to a center axis of the locking chamber for contacting a correspondingly inclined rear locking surface in a locking groove of the barrel.

6. The breech according to claim 5, wherein the angle $\alpha$ is 75°.

7. The breech according to claim 1, wherein the first and second cam elements engage with rear locking shoulders of the breech lever.

8. The breech according to claim 1, wherein the first and second cam elements interact with control surfaces on a system casing on which the breech is guided.

9. The breech according to claim 1, wherein the first and second cam elements rotate about a common cross axis in the breech guide.

10. A barrel for a breech of a repeating rifle comprising:

a) an annular locking groove arranged in a locking head of the barrel; and b) a rear locking surface inclined at an angle α of about 70° to about 80° relative to a center axis of the barrel, the rear locking surface contacting rear locking surfaces of a plurality of locking elements arranged on a locking sleeve.

11. The breech of claim 1, wherein the first cam is cooperative with movement of at least one of the breech lever and system casing to cause movement of the breech in a first manner, and the second cam is cooperative with movement of at least one of the breech lever and system casing to cause movement of the breech in a second manner different than the first manner.

12. The barrel according to claim 10, wherein the rear locking surface is inclined at an angle α of 75° relative to a center axis of the barrel.

13. A breech for a repeating rifle having a barrel and a system casing, comprising:

a breech guide slideable within the system casing;

a locking sleeve including a plurality of circumferentially spaced enlarged locking elements supported by resilient locking tongues;

a support sleeve slideable within an interior of the locking sleeve and configured to contact the plurality of circumferentially spaced enlarged locking elements to urge the locking elements radially away from the support sleeve and into engagement with the barrel in a locked position, and to release the locking elements to resiliently move away from engagement with the barrel in an unlocked position;

a breech lever rotatably connected to the breech and operative to displace the support sleeve to engage or disengage the locking elements with the barrel;

first and second cams separately rotatable with respect to the other, each of the first and second cams having a front cam surface engageable with the breech lever, and rear cam surface engageable with the system casing, the first cam cooperative with movement of at least one of the breech lever and system casing to cause movement of the breech in a first manner, and the second cam cooperative with movement of at least one of the breech lever and system casing to cause movement of the breech in a second manner different than the first manner.

14. The breech of claim 13, further including:

first and second legs rotatable in connection with the breech lever and having forward and rearwards engaging surfaces, the forward engaging surfaces configured to move the support sleeve, the rearwards engaging surfaces cooperative with the front cam surfaces of the first and second cams.

15. The breech of claim 13, wherein one of the first and second cams is operative to move the breech at a greater rate than the other cam element.

16. A breech for a repeating rifle having a barrel and a system casing, comprising:

a breech guide slideable within the system casing;

a locking sleeve including a plurality of circumferentially spaced enlarged locking elements supported by resilient locking tongues;

a support sleeve slideable axially within an interior of the locking sleeve and configured to contact the plurality of circumferentially spaced enlarged locking elements to urge the locking elements radially away from the support sleeve and into engagement with the barrel in a locked position, and to release the locking elements to resiliently move away from engagement with the barrel in an unlocked position;

first and second legs having forwards and rearwards engaging surfaces;

a breech lever rotatably connected to the breech and operative to rotate the first and second legs to displace the support sleeve to engage or disengage the locking elements with the barrel;

first and second cams separately rotatable with respect to the other, each of the first and second cams having a front cam surface engageable with a rearwards engaging surface of the first and second legs, and rear cam surface engageable with the system casing, the first cam cooperative with movement of at least one of the breech lever and system casing to cause movement of the breech in a first manner, and the second cam cooperative with movement of at least one of the breech lever and system casing to cause movement of the breech in a second manner different than the first manner.

17. The breech of claim 16, wherein at least one of the first and second cams is not configured to cause movement of the breech when the support sleeve is in a locked position.

18. The breech of claim 16, wherein one of the first and second cams has an enlarged cam element operative to move the breech at a greater rate than the other cam element.

19. The breech of claim 16, wherein only one of the first and second cams is operative to lock rotation of the breech lever during sliding of the breech.

20. The breech of claim 16, further including a locking chamber fixedly connected to a breech head, and wherein a portion of the support sleeve is disposed between the locking chamber and the locking elements when the support sleeve is in a locked position.

* * * * *